US006354793B1

(12) United States Patent
Gämmerler et al.

(10) Patent No.: US 6,354,793 B1
(45) **Date of Patent: *Mar. 12, 2002**

(54) STACK GRASPER FOR SHEET-LIKE PRODUCTS AND METHOD OF PALLETIZING USING A STACK GRASPER

(75) Inventors: Peter Gämmerler, Berg; Peter Gauges, Wolfratshausen; Michael Taffertshofer, Weilheim; Helmut Krickl, Geretsried, all of (DE)

(73) Assignee: Gammerler AG, Fed Rep (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/579,643

(22) Filed: May 26, 2000

Related U.S. Application Data

(63) Continuation-in-part of application No. 08/887,097, filed on Jul. 2, 1997, now Pat. No. 6,129,504.

(30) Foreign Application Priority Data

Jul. 3, 1996 (DE) ..... 196 26 802

(51) Int. Cl.[7] ..... B65G 57/00

(52) U.S. Cl. ..... 414/802; 414/788; 414/792.8; 414/792.9; 414/793.5

(58) Field of Search ..... 414/802, 793.5, 414/792.9, 792.8, 788

(56) References Cited

U.S. PATENT DOCUMENTS 6,062,403 A * 5/2000 Baumann et al. ..... 212/291

* cited by examiner

*Primary Examiner*—Donald P. Walsh
*Assistant Examiner*—Jeffrey A. Shapiro
(74) *Attorney, Agent, or Firm*—Fitch, Even, Tabin & Flannery

(57) ABSTRACT

A stack grasper, in particular for unbound printed products comprises a stack receiving space (22) which is open towards the bottom, a guide (14, 16, 18, 20) at all four sides of the stack receiving space, and a stack support (24, 26) on which the stack lies flat and substantially with its full length and/or width. It has the special feature that the stack support (24, 26) is arranged in the region of the lower end of the guide (14, 16, 18, 20) and is movable into and out of and into the stack receiving space (22) by a horizontal movement. This type of grasper ensures good guidance of the stack and a compact design suitable for a stack grasper attached to the arm of a robot.

10 Claims, 6 Drawing Sheets

5b

STACK GRASPER FOR SHEET-LIKE PRODUCTS AND METHOD OF PALLETIZING USING A STACK GRASPER

This is a continuation-in-part of prior application Ser. No. 08/887,097, filed Jul. 2, 1997, now U.S. Pat. No. 6,129,504, which is hereby incorporated herein by reference in its entirety.

FIELD OF THE INVENTION

The present invention relates to a stack grasper, in particular for unbound printed products comprising a stack receiving space which is open towards the bottom, a guide at all four sides of the stack receiving space, and a stack support on which the stack lies flat and substantially with its full length and/or width.

BACKGROUND OF THE INVENTION

Such stack graspers are known and serve to palletise stacks of printed products with the aid of a robot arm. In this arrangement the stack grasper is mounted at the end of a robot arm and takes over the stack from a supply device in order to subsequently deposit the stack on a pallet.

With stack graspers of the initially named kind, a drop shaft or chute which has approximately the height of a complete stack is arranged beneath the stack support. Individual stacks can admittedly be deposited on the pallet with a very small mutual spacing through this small drop shaft. An orderly placement of the stack is, however, not always possible without disturbing the orderly shape of the stack because the stack support is pivoted about a horizontal axis in order to free the stack and because the stack then falls over a relatively long distance within the drop shaft.

OBJECT OF THE INVENTION

It is accordingly the problem (object) underlying the present invention to so further develop a stack grasper of the initially named kind that the product stacks can be placed on pallets while remaining absolutely stable in shape.

BRIEF DESCRIPTION OF THE INVENTION

The solution of this object takes place in particular by an arrangement in which the stack support is arranged in the region of the lower end of the guide and in which the stack support is movable out of and into the stack receiving space by a horizontal movement.

Through the solution in accordance with the invention the stack no longer falls at all within the stack grasper within a predetermined path, because the stack support is arranged in the region of the lower end of the guide. Because the stack support can be moved out of the stack receiving space through a horizontal movement, it can be "drawn out" from beneath the stack, with the stack still being held on all sides by the guide. Thus, the lower side of the stack simply slides from the guide but does not, however, undergo any falling movement.

The stack grasper of the invention can be made very compact because the height of the stack grasper corresponds approximately to the maximum stack height. Moreover, the operation of the stack grasper of the invention produces very little noise because no flaps or fingers are present which have to be pivoted at high speed against an abutment in order to free a drop path.

Advantageous embodiments of the invention are set forth in the description, the drawing and the subordinate claims.

Thus, the stacking support can have at least one positioning cylinder, preferably a telescopic cylinder, as a support element. By using a cylinder of this kind, the stack support can be fully removed from the stack receiving space, without the stack support then projecting far into the space. This is of particular advantage since the working range of the robot should always be kept as small as possible. By using a telescopic cylinder, a situation can, however, be prevented in which parts project beyond the outer side of the stack grasper when the stack support is opened, so that the working range of the robot can be kept as small as possible.

In accordance with a further embodiment of the invention, the stack support has at least one flexible support belt. Through this embodiment a belt-like support is provided for the first time in a stack grasper, which can be "rolled off" or "peeled off" from the lower side of the stack, without a relative movement taking place between the stack support and the lowermost product of the stack. In this way the stack support can be removed from the stack receiving space without any friction, whereby the shape of the stack remains absolutely stable. This stack support can be moved into the receiving space by a telescopic cylinder or also by a thrust chain. A thrust chain of this kind is put together from individual links and can only be curved in one direction out of the straight shape. If a thrust chain of this kind is used without a belt-like support as a support element, then the stack can be deposited on a thrust chain of this kind or on a plurality of thrust chains. On movement of the thrust chain out of the stack receiving space it is, in each case, deflected about a deflection roller or about a guide for sliding movement with a horizontal axis, and is moved vertically upwardly outside of the stack receiving space. In this way, as with a positioning cylinder, the stack support can be drawn out from beneath the stack so that the latter slides from the support, but does not, however, drop.

It is particularly advantageous when the support belt is guided around a deflection roller or around a guide for sliding movement, with the upper run of the support belt being tensioned between the deflection roller and a holding point outside of the stack receiving space. At the same time, the lower run of the support belt can be withdrawn in order to move the stack support out of the stack receiving space. In this embodiment the support belt is removed from the stack receiving space in that the free end of the lower run is drawn out of the stack receiving space. Through this the displaceable deflection roller is displaced and the upper run of the support belt rolls off from the lower side of the stack, but without any relative movement taking place between the support belt and the lower side of the stack. It is particularly advantageous when the free end of the lower run is secured to a lifting cylinder, preferably a lifting cylinder without a piston rod, which is movable parallel to the guide. This embodiment ensures a compact design because the lifting cylinder without a piston rod can extend parallel to a rail of the guide, and thus likewise does not project very far into the space. At the same time, the guide rail can be used as a mounting for the lifting cylinder.

A particularly advantageous design of the invention is present when the holding point of the upper run of the support belt can be displaced opposite to the direction of movement of the stack support when the lower run is drawn out over a predetermined path. When removing the stack support, i.e. the positioning cylinder surrounded by the support belt, the stack does not execute any dropping movement. However, a certain vertical offset results at the lower side of the stack when the stack support is withdrawn from the stack receiving space. This vertical offset leads to a situation in which a certain offset arises at that side of the stack from which the stack support moves away, i.e. the edges of the products do not lie exactly above one another there. Through the above described embodiment, the upper run of the support belt can, however, be displaced on drawing out of the lower run by a predetermined amount, namely by the offset, opposite to the direction of movement of the stack support, whereby the lower stack region, which is not fully aligned, is displaced together with the upper run against the direction of movement of the stack support. In this way the lower stack region is again aligned in an orderly manner so that the outer edges of the stack form vertical surfaces. The displaceable mounting of the holding point of the upper run can, for example, be achieved by a resilient attachment of the holding point. The holding point can, however, also be displaced in a controlled manner at a certain point in time by a predetermined amount, with the point in time being capable of being selected in such a way that the offset which arises is ideally compensated, for example at the centre of the draw-out movement of the stack support.

It is particularly advantageous when the support belt is guided around a deflection roller which is arranged at the free end of the positioning cylinder or of the thrust chain. In this case the stack admittedly lies on the positioning cylinder, or on the thrust chain, but only contacts the support belt lying therebetween. On retraction of the positioning cylinder or of the thrust chain the support belt then rolls off from the lower side of the stack free of friction. The weight of the stack is, however, always carried by the positioning cylinder or by the thrust chain.

In accordance with a further advantageous embodiment, at least one hold-down device is provided within the stack receiving space and can be set against the upper side of the stack. In this way attention is paid to ensuring that no deformation of the stack occurs with the (very rapid) movement of the robot arm, and that no products, for example individual sheets, separate from the top side of the stack. Particularly when a situation exists in which the guide is not closed at all sides, but is rather, for example, formed by corner rails, then an air space remains between these corner rails, which under some circumstances leads to the topmost products being blown around with a rapid movement. It is particularly advantageous for this arrangement when the hold-down device is vertically adjustable within the full stack receiving space. Since holding down is then possible, even with varying stack height or with stacks which only consist of a few products. It is advantageous when the hold-down device is arranged above the stack support when seen from above. In this case the force which the hold-down device exerts extends precisely perpendicular to the stack support so that the stack does not undergo bending deflection but is rather clamped between the hold-down device and the stack support.

A particularly advantageous manner of operation results through the hold-down device, which is vertically movable within the stack receiving space, since in this case the hold-down device can also press onto the laid down stack when the stack grasper has already been lifted. The hold-down device is thus moved downwardly, opposite to the movement of the stack grasper, and exerts a pressure on the stack until the hold-down device has reached its lower end abutment. In this way the stack is kept together as a compact packet until the stack grasper has completely lifted from the stack. Any friction which arises between the products and the guide does not therefore have a negative effect on the alignment of the stack. An eventual air current which is caused by the upward movement of the stack grasper also has no effect on the alignment of the stack.

In accordance with a particularly advantageous embodiment, a signal generator can be provided which is arranged at the lower end point of the hold-down device. It is possible, through a signal generator of this kind, to generate a signal by the hold-down device which has reached its lower end point through lifting of the stack grasper, with the signal, for example, generating a vertical measurement value with the aid of the robot control. Thus, after each placement of the stack, the precise stack height can be determined in that the corresponding height value is read out from the robot control when the signal generator responds. This represents a substantially more reliable solution when compared to ultrasonic sensors or the like. Moreover, the individually determined measured height values for one layer can be averaged, and this average value can be used for the control for the subsequent stack layer. Two hold-down devices are preferably provided, which in each case cooperate with a signal generator. In this way a good vertical measurement can be achieved by average value formation.

Finally, the guide of the stack receiving space can be provided with aligned cut-outs, which enable the removal of a supply device from the stack receiving space. In this way products with very small format can also be transported by the stack grasper since the all-sided guide can be moved up to the product and a removal of the supply device from the stack receiving space is nevertheless possible.

DESCRIPTION OF THE PREFERRED EMBODIMENT

The invention will be described in the following purely by way of example with reference to an advantageous embodiment and to the accompanying drawing.

The figure shows a perspective view of a stack grasper in accordance with the invention.

Figure 1:
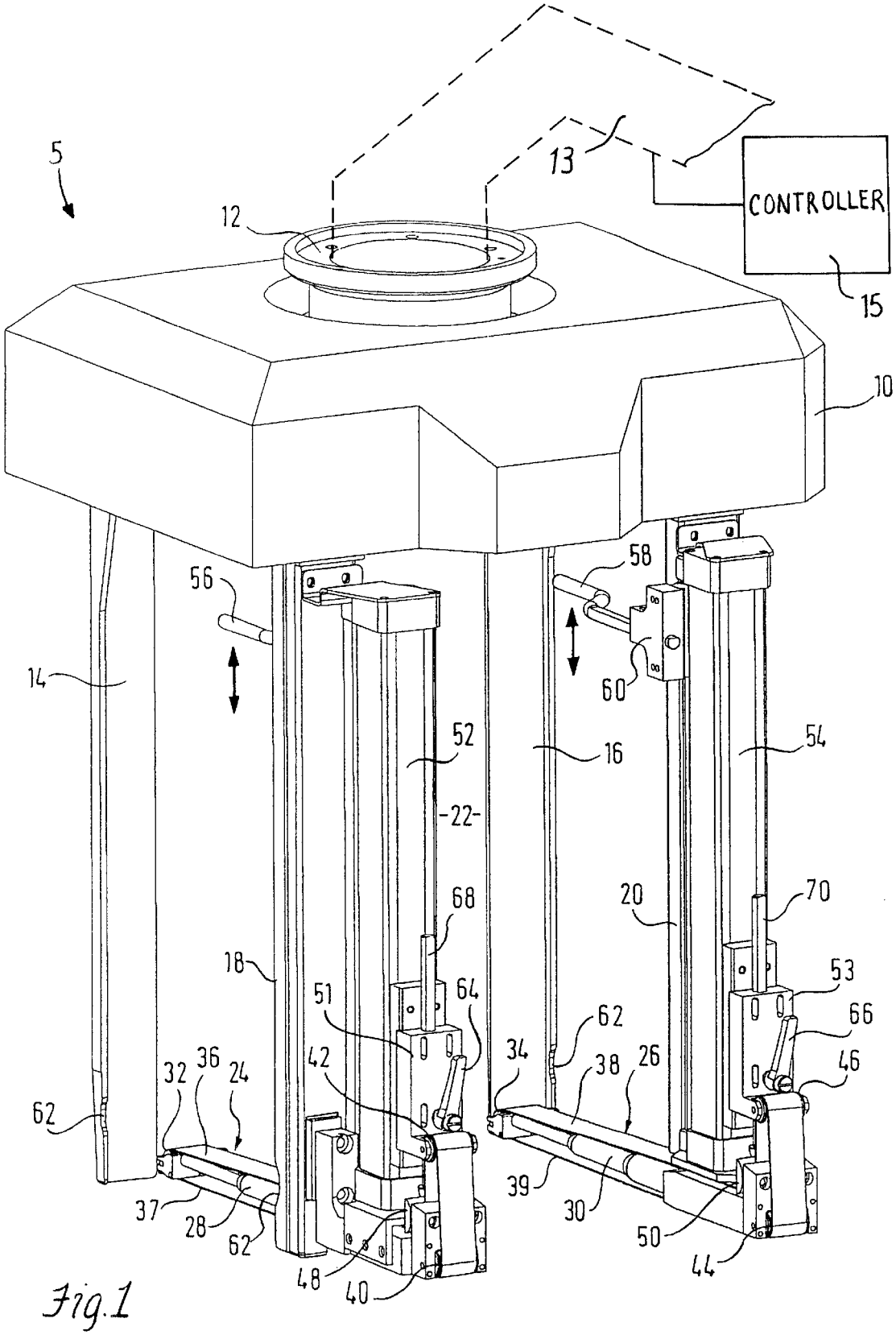
FIG. 1 is a perspective view of a stack grasper in accordance with the present invention showing guides for the stack and stack supports including cylinders and respective support belts.

The stack grasper of the invention consists of an upper part 10 with a circular flange 12 attached to its upper side in order to secure the stack grasper to an arm 13 of a robot as shown in FIG. 1. The robot arm 13 can be electronically controlled via controller 15, as will be discussed more fully hereinafter. A total of four guides 14, 16, 18, 20 are mounted on the upper part 10 and guide the stacks on all sides. Preferably, the guides are respectively formed as elongate rails of L-shaped cross-section which extend longitudinally or vertically from the upper part 10 and guide the stack at its four corners. In this way a good guidance is obtained, on the one hand, and the friction between the stack and the guide is reduced, on the other hand. The guide rails 14, 16, 18, 20, which form a stack receiving space or compartment 22 having the upper part 10 of the grasper 5 at the top thereof and which is open towards the bottom, are each secured in the upper part 10 so as to be capable of displacement in parallel whereby, on the one hand, a format adjustment can take place and, on the other hand, the stack receiving space can be widened for the introduction of a stack and can be made smaller after the introduction of a stack. The displacement of the guide rails takes place in this arrangement through parallel guides, which are not shown in more detail.

Figure 5A:
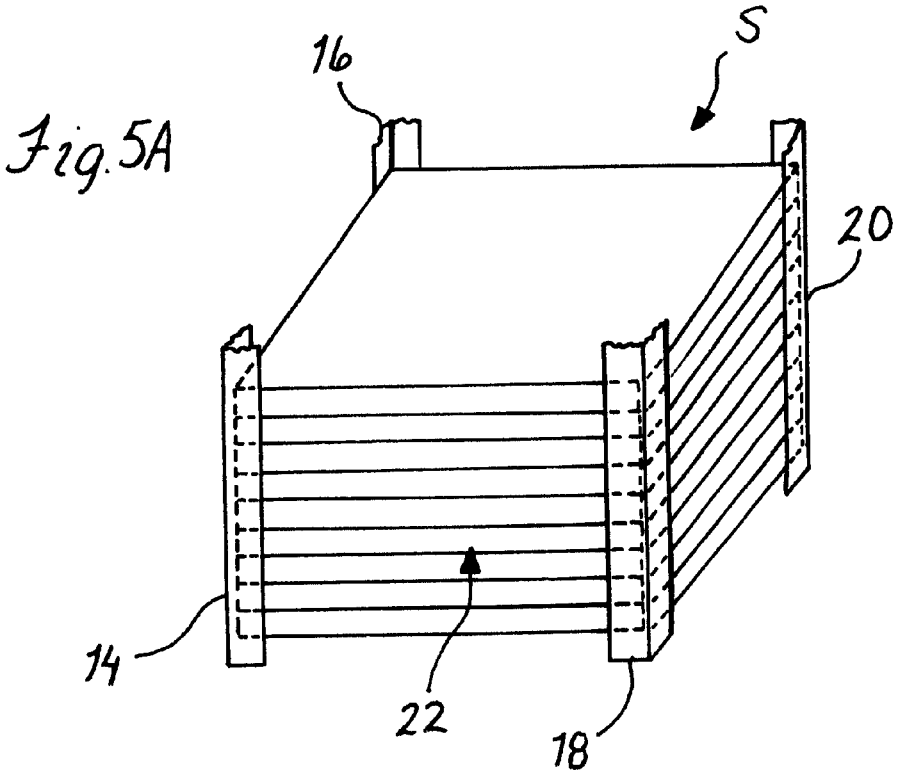
FIG. 5A is a fragmentary perspective view of the guides and the stack showing a receiving compartment for the stack formed by the guides.
Figure 5B:
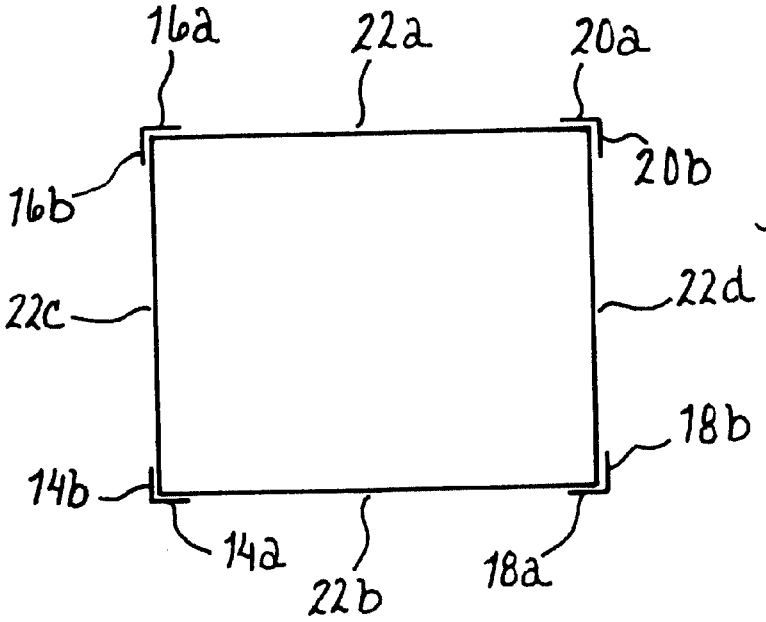
FIG. 5B is a plan view of the guides and stack showing portions of the guide being disposed along each side of the receiving compartment and the stack therein.

Referring more particularly to FIGS. 5A and 5B, there it can be seen that the elongate guides 14, 16, 18, and 20 bound and define a receiving compartment 22 having a configuration closely matching that of the sheet products forming the stack, S, therein. As the sheet products can have a rectangular or square configuration, the compartment 22 as formed by the guides 14, 16, 18, and 20 at predetermined positions thereabout includes four sides 22*a,* 22*b,* 22*c,* and 22*d* thereof. Further, as the stack S has a vertical height, the compartment sides 22*a*–22*d* extend vertically between the top and bottom of the compartment 22 along the longitudinal extent of the guides between upper and lower ends thereof. To this end, the guides 14, 16, 18, 20 include portions that are disposed along each compartment side 22*a*–22*d* for confining the stacks in the compartment 22 and providing guidance along each of the four side edges of the sheet products in the stack S, such as during take-up and depositing of the stack S at its desired transfer or deposit location. In the illustrated and preferred form, the guides 14, 16, 18, and 20 are provided at the four corners of the compartment 22 which are formed at the juncture of the compartment sides 22*a*–22*d* and, as mentioned, have a right angle or L-shaped cross-section so that each guide includes respective portions that are disposed at right angles with respect to each other and extend along adjacent compartment sides forming the compartment corner at which the particular guide is positioned, as best seen in FIG. 5B. Accordingly, guide 14 has portions 14*a* and 14*b* disposed along compartment sides 22*b* and 22*c,* respectively; guide 16 has portions 16*a* and 16*b* disposed along compartment sides 22*a* and 22*c,* respectively; guide 18 has portions 18*a* and 18*b* disposed along compartment sides 22*b* and 22*d,* respectively; and guide 20 has portions 20*a* and 20*b* disposed along sides 22*a* and 22*d,* respectively. Thus, compartment side 22*a* is defined or delimited by spaced guide portions 16*a* and 20*a* at opposite ends thereof; side 22*b* is defined by guide portions 14*a* and 18*a;* side 22*c* is defined by guide portions 14*b* and 16*b;* and side 22*d* is defined by guide portions 18*b* and 20*b.* In this manner, all four side edges of the stack sheet products are confined against lateral shifting by the above-described guide portions, and in particular each edge is confined by spaced portions of two guides to maintain the alignment of the sheet products in the stacks so as to allow the grasper 5 herein to transport stacks and deposit them without losing control over the shape of the stacks. For this purpose, stack supports and hold-down devices are provided which cooperate with the guides, as described hereinafter.

A stack support 24, 26 on which the stack is supported in a flat manner over its full length and/or width is located at the lower end of the guide rails. The flat support of the stack is important, since it would not be possible to unload the stack in a stable shape if, for example, the stack is supported in a curved manner within the stack grasper.

Figure 4:
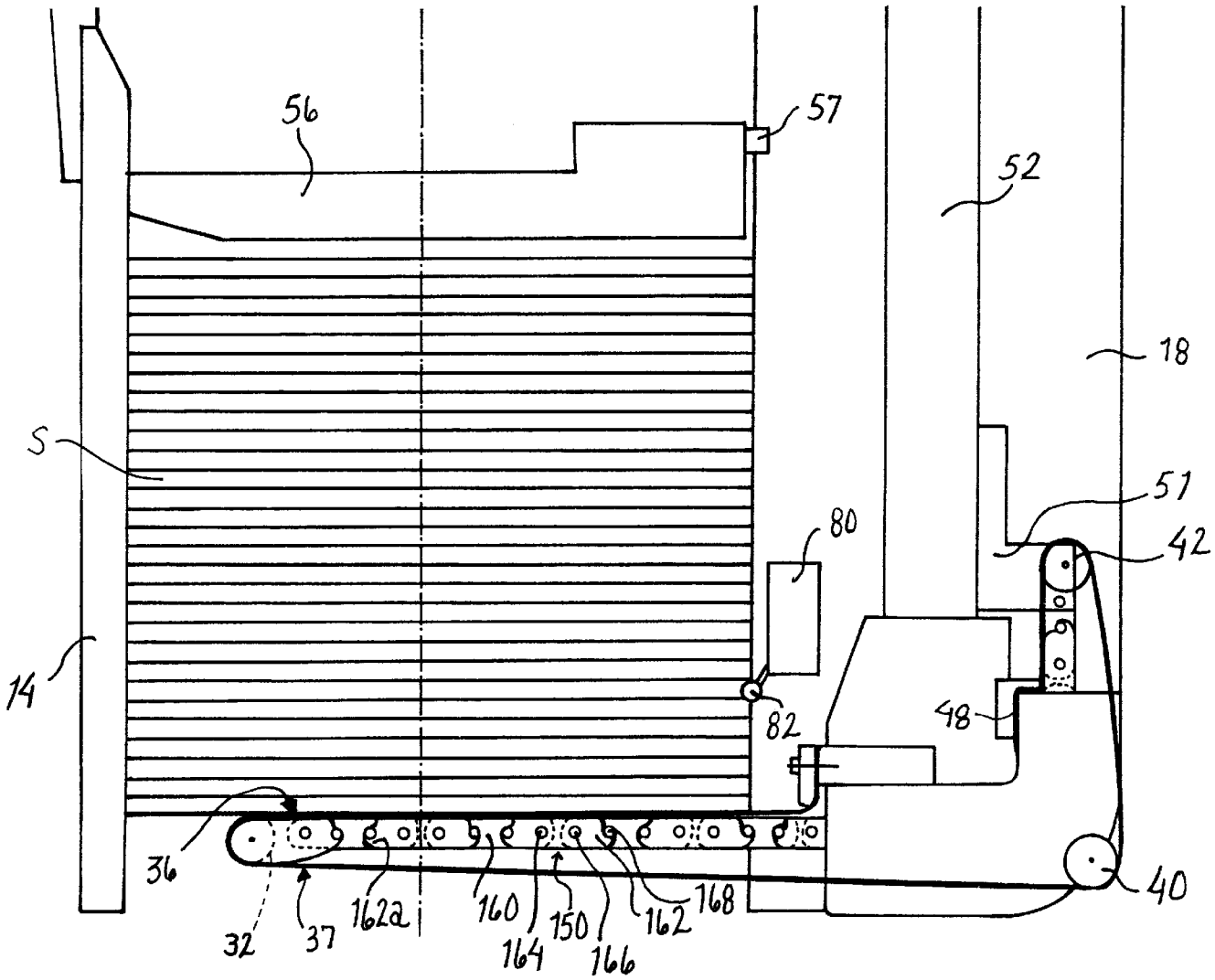
FIG. 4 is a side elevational view of another stack grasper showing one of the stack supports including a thrust chain and support belt, and the stack height sensor and hold-down device including respective actuators thereof.

Continuing with reference to the grasper 5 of FIG. 4 the main elements of the supports 24 and 26 are in each case telescopic cylinders 28, 30. A deflection roller 32, 34, which is rotatable about a horizontal axis extending perpendicular to the telescopic cylinder, is secured to the front end of the respective telescopic cylinder 28, 30 by means of a holder. The telescopic cylinders 28, 30 are arranged in such a way that the deflection rollers 32, 34 attached to their front ends are located outside of the stack receiving space 22 when the cylinders are fully retracted. In the figure only one telescopic cylinder 28, 30 can admittedly be recognised in each case. However, in practice, two telescopic cylinders which lie parallel alongside one another are provided in each case, with a guide roller 32, 34 being secured to the front end of each telescopic cylinder.

The stack supports 24, 26 have a flexible support belt or band 36, 38 alongside the telescopic cylinders 28, 30 as a further support element, and the flexible support belt is in each case guided about a respective deflection roller 32, 34. The free end of the respective upper run is thereby secured to a holding point outside of the stack receiving space 22. The lower run 37, 39 of the support belts is led out of the stack receiving space 22 at the lower side of the telescopic cylinders 28, 30 and is guided around two further deflection rollers 40, 42 and 44, 46 respectively. The free end of the lower run is finally fixed in place, at a fixed location, at a holder 48, 50.

The deflection rollers 40, 44 are respectively journalled at a fixed location on the associated guides 18, 20. The deflection rollers 42, 46 are, however, secured to a cylinder 52, 54 which does not have a piston rod, which extends parallel to the associated guide rails 18, 20 and is secured to the latter. Thus, the lower run 37, 39 of the support belts 36, 38 are removed from the stack receiving space 22 by a vertically upward movement of the carriages 51, 53, provided the telescopic cylinders 28, 30 are simultaneously retracted, for example by venting. At the same time the upper run of the support belts 36, 38 rolls off from the lower side of the stack, i.e. the stack slides from the supports 24 and 26 within the stack receiving space. When the carriages 51, 53 are located at their upper end point, the telescopic cylinders 28, 30 are fully retracted and both the support belts 36, 38 and also the deflection rollers 32, 34 are located outside of the stack receiving space. The stack supports 24 and 26 have then been drawn out from beneath the stack, i.e. the stack lies flat on its support.

A hold-down device 56, 58 is, furthermore, arranged on each of the guide rails 18 and 20. Each hold-down device is of bar-like form and bent towards the outside in such a way that the contact takes place as close as possible to the edges of the stack. In this way a lateral fanning out of the stack is prevented. Each hold-down device is secured to a carriage 60, which can be moved up and down by means of a linear cylinder within the stack receiving space 22 parallel to the respective guide rail 18, 20.

A cut-out 62 is in each case provided at the lower end of each guide rail 14, 16, 18 and 20, with the two respective cut-outs being aligned with one another in each case. These cut-outs make it possible for an apparatus which guides the stack to be withdrawn from a stack grasper, even when a very small format has been selected. For larger formats the cutouts can also be closed so that they are not a source of disturbance.

The manner of operation of the stack grasper of the invention will be described in the following.

In order to be able to unload a stack on a pallet at the desired position, the stack grasper which is secured to a arm 13 of a robot is pivoted into the region of a supply device which "hands over" the stack, for example with grippers at the top and bottom. The stack grasper of the invention is in this arrangement placed in front of the supply device in such a way that the stack handed over can be introduced into the stack receiving space 22 transversely to the stack supports 24, 26. As the guide rails 14, 16 and 18, 20 are spaced apart sufficiently that the stack can be passed through between them, the stack can be introduced into the stack receiving space without contact. Once the supply device has stopped, the guides 14, 16, 18 and 20 are adjusted so that they surround and contact the stack on all sides. Hereupon the supply device can be withdrawn from the stack grasper so that the bottom side of the stack comes to lie on the supports 24 and 26. Depending on the speed of the robot, the stack grasper can, however, also be lowered onto the handed over stack from above.

After pivoting of the robot arm to the desired position on the pallet, the stack grasper is positioned at a small distance from the support surface so that no contact takes place between the moving lower run of the support bands 36, 38 and the support surface. Thereafter, the telescopic cylinders 28, 30 are vented and at the same time the lifting cylinders 52, 54 are synchronously actuated so that the carriages 51, 53 move upwardly. Through this movement the lower run 37, 39 of the support belts 36, 38 at the lower side of the positioning cylinders 28, 30 are drawn out from the stack receiving space with the positioning cylinders 28 and 30 simultaneously becoming shorter. During this procedure the upper run of the support belts rolls off from the lower side of the stack so that the stack slides from the supports 24 and 26 but does not fall. In this manner, the supports 24 and 26 in cooperation with the guide rails 14, 16, 18 and 20 execute a transfer of the stack S to a support surface at its desired deposit location with a minimum of vertical shifting of the stack so that the entire stack does not undergo falling action during transfer to the support surface while simultaneously minimizing literal shifting of the stack during such transfer, thus keeping the stack S intact after the grasper supports 24 and 26 are retracted from under the stack.

At approximately the middle of the stroke of the telescopic cylinders 28, 30 the respective holding point of the upper run of the support belts is moved by a predetermined amount relative to the retraction direction of the telescopic cylinders 28, 30. In this way the lowermost products of the stack move towards the rails 14, 16, which in this case serve as abutments, whereby the correct alignment of the stack is ensured.

After the end of the upward movement of the lifting cylinders 52, 54, i.e. the retraction movement of the telescopic cylinders 28, 30, each support belt 36, 38 has been removed from the stack receiving space 22 and the stack lies with the correct alignment on its support. Hereafter, the stack grasper is lifted upwardly while the hold-down devices are moved in the opposite sense downwardly and still press on the top side of the stack. In this manner, the hold-down devices 56 and 58 along with the guides 14, 16, 18 and 20 cooperate to keep the stack properly arranged in its desired shape or configuration as the grasper 5 is lifted with the lower end of the guide rails moving up and past the products in the stack. When the hold-down devices 56, 58 have reached their lower end position, they actuate stack sensor or signal transducer 80 and the vertical position value is read out from the robot control 15. Immediately thereafter, the stack grasper lifts off fully from the stack and is moved in the direction of the hand-over device so that the cycle can start anew.

Figure 2:
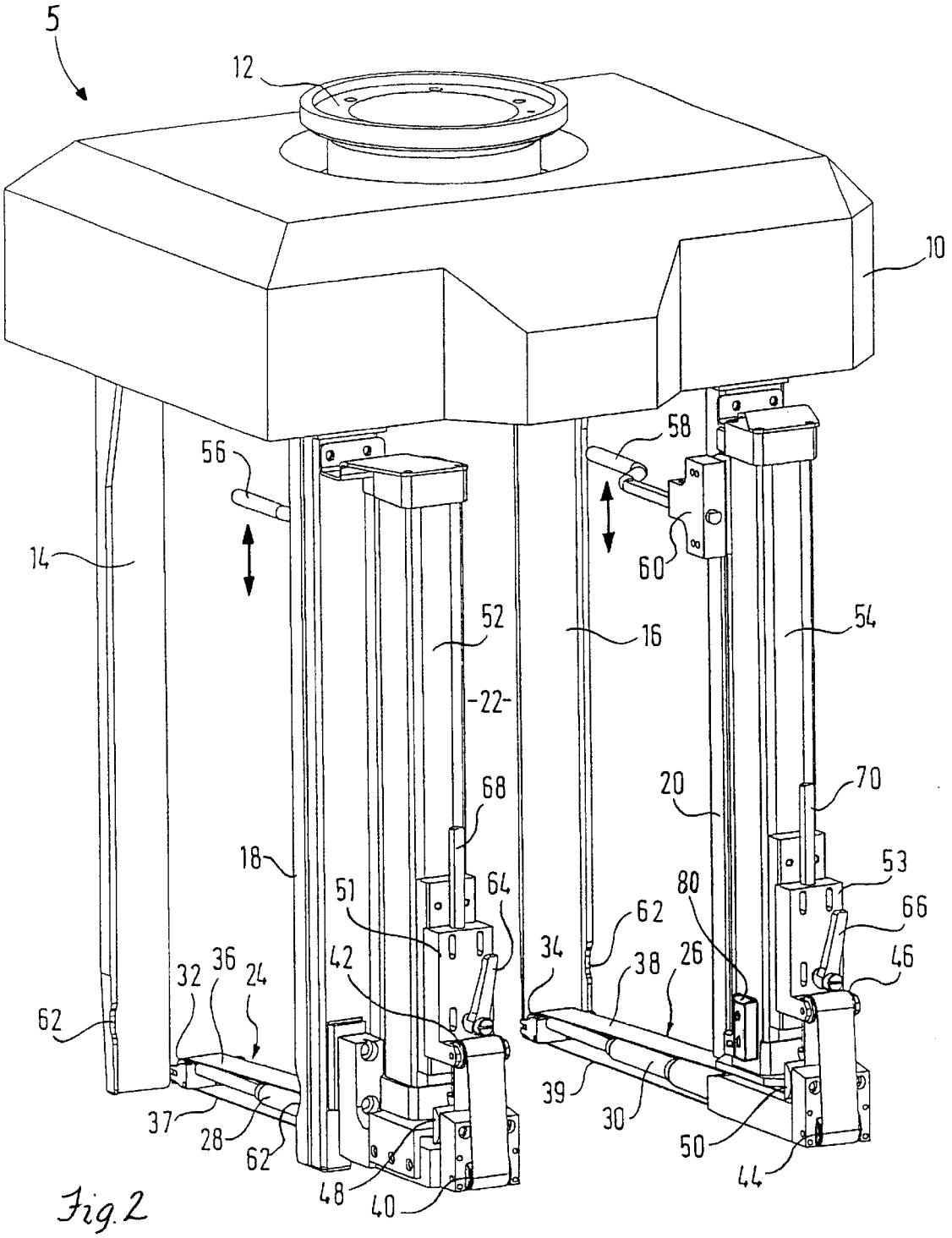
FIG. 2 is a perspective view of the stack grasper unit of FIG. 1 showing a stack height sensor adjacent the bottom of one of the guides for cooperating with a hold-down device that is slidable along the guide.
Figure 6:
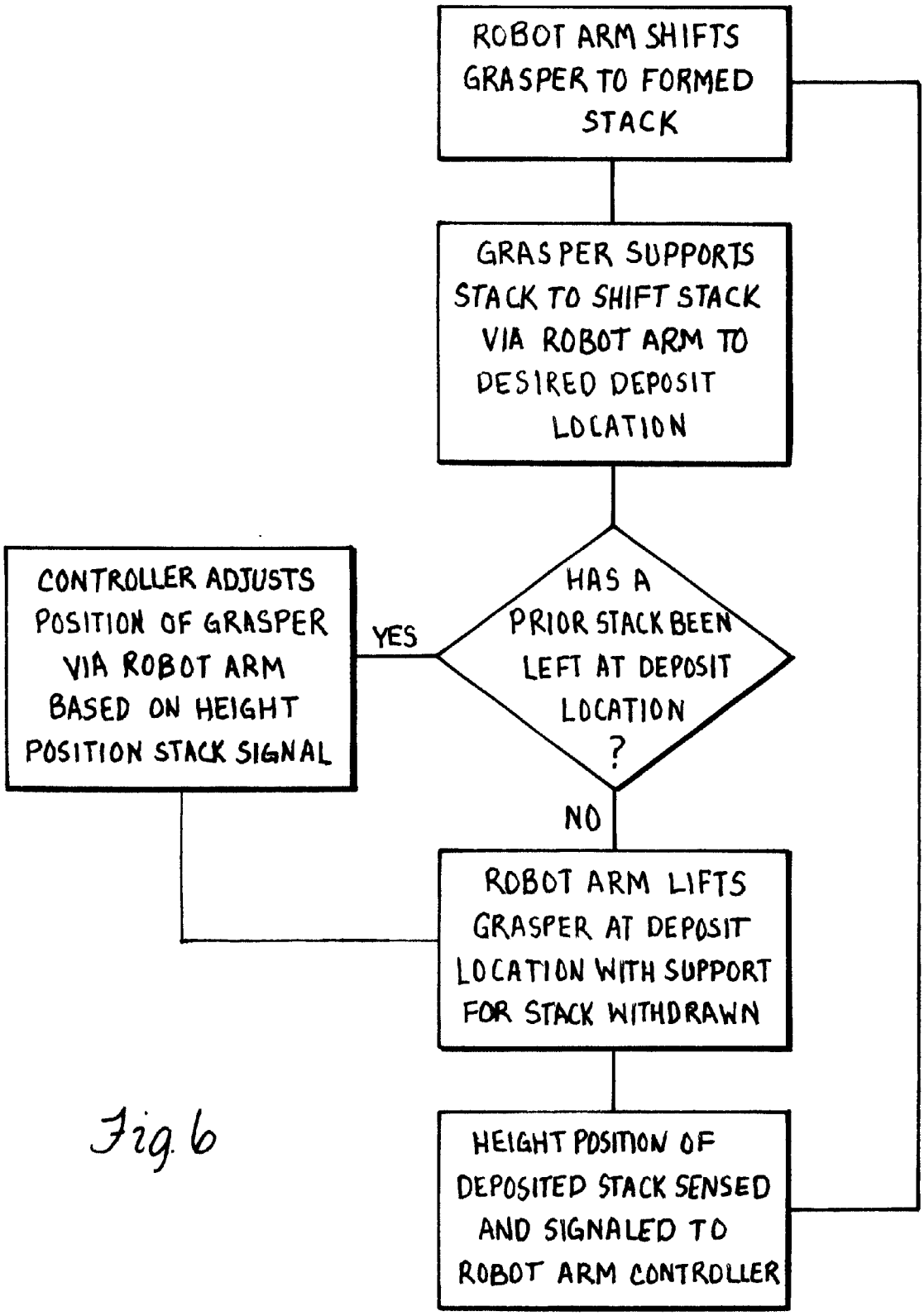
FIG. 6 is a flow chart of a method of depositing stacks using the stack grasper with an electronically controlled robot arm in accordance with the present invention.

Referring to FIGS. 2, 4 and 6, the signal transducers 80 are shown in the form of microswitches each including an actuator 82 with the switches 80 disposed toward the bottom of the compartment 22 mounted adjacent the lower ends of respective guides 18 and 20. The hold-down device 56 mounted for slidable movement along guide rail 18 includes an actuator 57 for cooperating with the switch actuator 82 during stack depositing. When the stack grasper 5, or stack graspers 5*a* or 5*b* described hereinafter, is lifted upwardly by the arm 13 with the hold-down devices 56, 58 disposed at the level of the supports 24, 26 such that the stack S has been deposited on the support surface at the desired deposit location, the hold-down device actuator 57 will actuate the switch actuator 82 causing the switch 80 to signal the robot arm controller 15 with a value representative of the height of the just deposited stack, S, taking into account the previously deposited stacks thereunder. More specifically, the controller 15 can be initialized with information relating to the coordinates in x, y and z directions of the stack receiving and depositing locations between which the robot arm 13 is shifted under command of the controller 15. The z-axis or vertical height value at which the support surface at the deposit location is disposed will be changed in the controller 15 such as when a predetermined number of stacks have been transferred to completely form the lowermost layer on a pallet. To this end, the z-axis height value of a just deposited stack determined by the signal from the switch 80 is stored with reference to the particular x-y location on the pallet due to any previous stacks deposited thereat so that the z-axis value is an absolute height value which can be the height of a single stack, or multiple stacks depending on the number of already deposited stacks at a particular deposit location. The controller 15 then utilizes this stack position or height information for positioning of the robot arm 13 and grasper 5, 5*a,* 5*b* carried thereby at the deposit location to take into account previously deposited stacks, S. This method is shown best in the flow chart of FIG. 6.

For instance, if stacks S are to be transferred onto a pallet, once the initial level or layer of stacks are transferred onto the pallet via the grasper 5, 5*a,* 5*b,* a subsequent higher layer is to be transferred onto the initially deposited layer. For this purpose, the height value of the stacks S is utilized by the controller 15 so that the movements of the robot arm 13 are controlled to adjust the level to which the grasper units are shifted to take into account any previously deposited stacks at a particular position on the pallet and thus the height position of the support surface onto which the stacks held by the grasper units are to be deposited. Accordingly, the stack sensors 80 can provide highly accurate information as an incident of the stack depositing action undertaken by the grasper units to allow the controller 15 to precisely position the supports 24 and 26 adjacent the top of previously deposited stacks S to avoid a free-falling action of the stacks S being transferred by the units.

If a different format setting is required, the guide rails 14, 16, 18 and 20 are correspondingly adjusted. If, for example, product stacks are conveyed which have a smaller width then the guide rails 14, 16 and 18, 20 are moved towards one another and locked in this position. In order to correspondingly restrict the maximum stroke of the telescopic cylinders 28, 30 with different formats, each carriage 51, 53 can be adjusted by means of a hand lever 64, 66 on an associated guide rod 68, 70 so that the support belt 36, 38 is tensioned.

In accordance with an alternative embodiment, an abutment is provided which restricts the maximum stroke of the lifting cylinders 52, 54 or of the thrust chain 150, 151. This abutment is advantageously associated with the format adjustment via a cable deflection, whereby the maximum stroke of the support is restricted, depending on the format set, in a manner which is simple design-wise.

Figure 3:
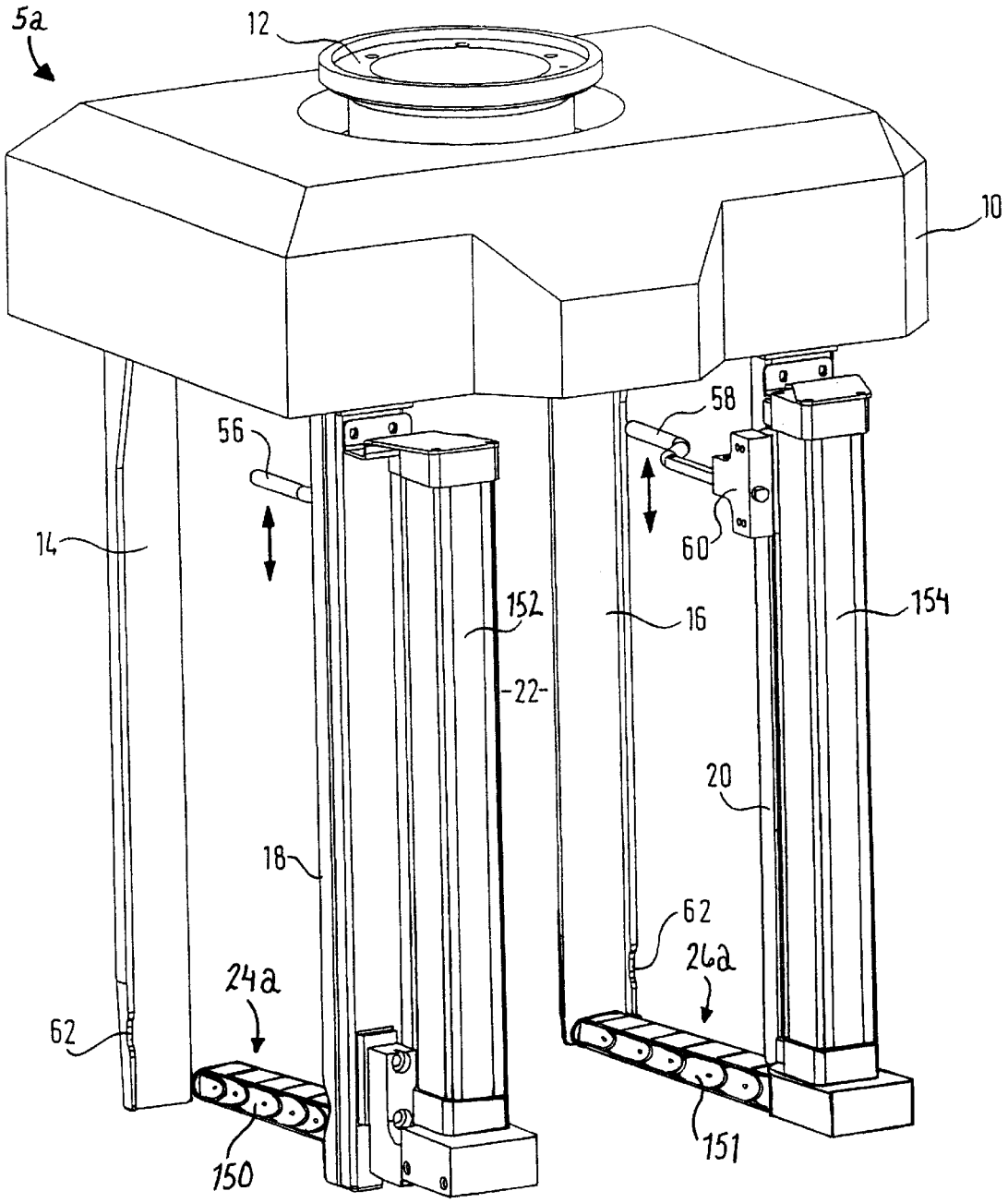
FIG. 3 is a perspective view similar to FIGS. 1 and 2 of a stack grasper unit showing stack supports in the form of thrust chains.

FIG. 3 shows a stack grasper 5*a* similar to previously-described grasper unit 5 however instead of cylinders 28, 30 and associated belts 36, 38 forming the stack supports 24, 26, the above-mentioned thrust chains 150, 151 are provided at the lower ends of the guide rails. The lowermost product in the stack S is supported directly on the chains 150, 151 in the grasper 5 of FIG. 3. For depositing the supported stack S on a support surface at the desired deposit location, the chains 150, 151 are withdrawn from the compartment 22 in a linear direction transverse to the longitudinal extent of the guides and rerouted once exterior of the compartment 22 into respective chain housings 152, 154 which extend parallel to the guides 18 and 20, thereby maintaining a compact form of the grasper 5*a* similar to grasper 5. In addition, the linear retracting of the chains 150, 151 allows for high speed transfer of the support of the stack S to the support surface and without requiring that the stack undergo a drop or free-falling action onto the support surface.

Alternatively, the thrust chains 150, 151 can be used in conjunction with support belts 36, 38, one of which is shown in FIG. 4. As can be seen, the thrust chain 150 includes chain members 160 and 162 hinged together by way of joints or pivot pins 164 and 166. The chain members 160 include abutments in the form of bolts 168 that are positioned to engage extension portions 162*a* of the chain members 162 thereby limiting pivoting of the chain members 162 and thus turning of the chains 150, 151 to one direction. In this regard, the supports of the grasper unit all operate similarly in that they are withdrawn with a linear movement out from the space 22 via a redirection for travel in a vertical path along the longitudinal extent of the guides. Not only does this provide the aforedescribed advantages in transfer of the stack to a support surface, the units can be very compact. In addition to the fact that the withdrawn supports are arranged alongside the guides, the linear movement out from the stack receiving compartment 22 allows for the units to have a height that can be sized to correspond to the maximum stack height the unit is to handle. This is because the portions 24*a* and 26*a* of the respective supports 24, 26 that extend into the stack receiving compartment 22 are at a predetermined position that remains fixed with respect to the longitudinal extent of the guides. Thus, the guides 14, 16, 18 and 20 can be sized from their upper ends to their lower ends to substantially match the maximum stack height, and the operation of the stack supports 24 and 26, including portions 24*a* and 26*a* will not cause the height of the unit to vary, such as with prior units that use pivoting supports.

With respect to the method of using the stack sensor 80 with the units 5*a* and 5*b*, it is substantially the same as previously described with unit 5. In this regard, the microswitch 80 which serves as a limit switch, is actuated by the hold-down device 56 if the hold-down device 56 has been lowered to the upper edge of the thrust chain. The limit switch 80 may be in the form of a microswitch or of a reed contact, or it may be any other switch. When stack S is placed onto a pallet, carrier 51 is moved upwardly and the belt 36, 38 and the thrust chain 150 is withdrawn. Thereafter, the palleting device is moved upwardly by means of a robot arm and simultaneously the hold-down device 56 is moved downwardly to press down the stack in a downward direction. When the hold-down device 56 has reached its bottom position, the signal generator 80 (microswitch, reed contact) is actuated and this signal is transmitted to the control of the robot. The vertical distance by which the robot arm has been moved exactly corresponds to the height of the stack. Thus, the z-value of the robot arm which is determined when the switch 80 is actuated can be used for calculating the actual stack height. This information can be used for placing another stack on the top of the previous stack, as previously discussed.

What is claimed is:

1. Stack grasper apparatus for stacks of unbound printed products having four side edges, the apparatus comprising:

a stack receiving compartment having a top and a bottom, and four sides extending between the compartment top and bottom, the compartment being open towards the bottom;

guides which substantially define the compartment including the sides thereof and each having upper and lower ends with the guides extending between their respective upper and lower ends and having predetermined positions relative to each other so that there are guides at all sides of the stack receiving compartment for orienting the printed products with their side edges extending along the compartment sides; and a stack support on which a stack lies flat, the stack support being connected to the lower ends of the guides, and the stack support being linearly movable in a substantially horizontal direction transverse to the guides out of and into the stack receiving compartment.

2. Apparatus in accordance with claim 1, wherein the stack support has one of at least one positioning cylinder and at least one thrust chain.

3. Stack grasper apparatus for stacks of unbound printed products comprising:

a stack receiving compartment having a top and a bottom, and sides extending between the compartment top and bottom, the compartment being open towards the bottom;

guides which substantially define the compartment including the sides thereof and each having upper and lower ends with the guides extending between their respective upper and lower ends and having predetermined positions relative to each other so that there are guides at the sides of the stack receiving compartment; and a stack support on which a stack lies flat, the stack support being disposed generally at the lower ends of the guides, and the stack support being linearly movable in a substantially horizontal direction transverse to the guides out of and into the stack receiving compartment, wherein the stack support has at least one flexible support belt which includes an upper run for supporting the stack, and a lower run, and the belt is guided over one of a displaceable deflection roller and a slide guide, and wherein for a movement out of the stack receiving compartment the lower run can be withdrawn from the stack receiving compartment while the upper run is tensioned between the deflection roller or guide and a holding point outside of the stack receiving compartment.

4. Apparatus in accordance with claim 3, wherein a portion of the lower run is moved by one of a lifting cylinder and a thrust chain traveling parallel to one of the guides extending along the stack receiving compartment.

5. Apparatus in accordance with claim 3, wherein the support belt is guided around said deflection roller, and said slide guide which is arranged at a free end of one of a positioning cylinder and a thrust chain.

6. Apparatus in accordance with claim 1, wherein a hold-down device is provided inside of the stack receiving compartment and can be set against the upper side of the stack and is vertically adjustable within the stack receiving compartment.

7. Stack grasper apparatus for stacks of unbound printed products, the apparatus comprising:

a stack receiving compartment having a top and a bottom, and sides extending between the compartment top and bottom, the compartment being open towards the bottom;

guides having upper and lower ends with the guides extending between their respective upper and lower ends along the sides of the stack receiving compartment; and a stack support on which a stack lies flat, the stack support being disposed generally at the lower ends of the guides, and the stack support being movable in a substantially horizontal direction transverse to the guides out of and into the stack receiving compartment;

wherein a hold-down device is provided inside of the stack receiving space and can be set against the upper side of the stack and is vertically adjustable within the stack receiving compartment, at least one signal transducer for determining an absolute stack height value and arranged at a lower end point of the hold-down device.

8. Stack grasper apparatus for stacks of unbound printed products comprising:

a stack receiving space; and a stack support on which a stack lies flat, the stack support being movable in a substantially horizontal direction out of and into the stack receiving space, wherein a hold-down device is provided which can be set against the upper side of the stack and which is vertically adjustable, wherein at least one signal transducer for determining an absolute stack height value is provided which is arranged at a lower end point of the hold-down device.

9. A method of transferring stacks of products having four side edges, the method comprising:

providing a stack grasper apparatus having elongate guide members bounding a stack receiving compartment along four sides of the compartment, and a stack support on which the stack of products can be supported;

orienting a stack of products in the stack receiving compartment so that the edges of the products extend along the sides of the compartment by positioning the guides at all four sides of the compartment with the bottommost product of the stack in engagement with the stack support extending into the stack receiving compartment;

transferring the product stack received in the stack receiving compartment from one location to another desired transfer location;

positioning the stack support closely adjacent a support surface at the transfer location;

linearly moving the stack support transverse to the elongate guide members and out from the stack receiving compartment to allow the bottommost product to be transferred onto the support surface with the guide members keeping the stack aligned during such transfer so as to avoid having the product stack undergo a free falling action and subjecting the stack to misalignment when the stack support is moved out from the stack receiving compartment for transferring the stack to the support surface.

10. An apparatus for grasping a preformed stack of items having four side edges for transferring the stack to a support surface, the stack grasping apparatus comprising:

a stack receiving compartment having a top and a bottom and four sides extending in a longitudinal direction between the compartment top and bottom;

a plurality of elongate guide members extending longitudinally between the top and bottom of the compartment, the guide members being at predetermined positions about the compartment so that portions thereof are disposed at each and every side of the compartment so as to limit transverse shifting of the items in the preformed stack when received in the stack receiving compartment; and a shiftable stack support fixed longitudinally relative to the guide members towards the bottom of the compartment, the support being linearly shiftable in a substantially horizontal direction transverse to the longitudinally extending guide members into the stack receiving compartment for supporting the preformed stack thereon, and out from the stack receiving compartment for transferring the preformed stack onto a support surface with the portions of the guide members keeping the items in their preformed stacked alignment during the transfer operation.

* * * * *